US006235325B1

(12) United States Patent
Greitzer

(10) Patent No.: US 6,235,325 B1
(45) **Date of Patent: *May 22, 2001**

(54) FOOD PRODUCT CONTAINED IN AN IMITATION EGG SHELL

(76) Inventor: Melvin A. Greitzer, 8419 Blackburn Ave., Los Angeles, CA (US) 90048

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/282,010

(22) Filed: Mar. 29, 1999

Related U.S. Application Data

(60) Provisional application No. 60/100,700, filed on Sep. 17, 1998.

(51) Int. Cl.[7] ..... B65D 81/34

(52) U.S. Cl. ..... 426/123; 426/106; 426/115; 426/112; 426/412; 426/414; 426/515

(58) Field of Search ..... 426/412, 115, 426/298–301, 515, 414, 413, 122, 123, 106, 112

(56) References Cited

U.S. PATENT DOCUMENTS

| | | | | |
|---|---|---|---|---|
| 211,859 | * | 2/1879 | Manley | 426/515 |
| 499,426 | * | 6/1893 | Hill | 426/515 |
| 1,334,346 | * | 3/1920 | Boehm | 426/122 |
| 1,684,421 | * | 9/1928 | Thompson | 426/123 |
| 2,660,530 | * | 11/1953 | Adams | 426/299 |
| 2,756,155 | * | 7/1956 | Hale | 426/299 |
| 2,858,224 | * | 10/1958 | Darrah | 426/299 |
| 3,285,749 | * | 11/1966 | Shires | 426/299 |
| 3,451,539 | * | 6/1969 | Wysocki | 426/122 |
| 3,510,054 | * | 5/1970 | Sanni et al. | 426/122 |
| 3,851,571 | * | 12/1974 | Nichols | 426/120 |
| 4,189,054 | * | 2/1980 | Liu et al. | 426/122 |
| 4,244,470 | * | 1/1981 | Burnham | 426/515 |
| 4,784,273 | * | 11/1988 | Niemetz | 426/122 |
| 4,923,702 | * | 5/1990 | Powell et al. | 426/122 |

FOREIGN PATENT DOCUMENTS

| | | | | |
|---|---|---|---|---|
| 2425808 | * | 5/1978 | (FR) | 426/412 |
| 1604151 | * | 12/1981 | (GB) | 426/412 |
| 2276524 | * | 10/1994 | (GB) | 426/412 |
| 61-15664 | * | 1/1986 | (JP) | 426/414 |
| 7115896 | * | 5/1995 | (JP) | 426/119 |

OTHER PUBLICATIONS

Food Industries 5/43, p.67, copy in 426/299, May, 1943.*
Monthly New Food Products in Japan 10(6) p.13 (Dialog Abstract), Jun. 1985.*
Monthly New Food Products in Japan 12(4) p. 24 (Dialog Abstract), Apr. 1987.*
Japanese Packaging Report (8) 1987, p. 19–20 (Dialog Abstract).*

* cited by examiner

*Primary Examiner*—Steven Weinstein
(74) *Attorney, Agent, or Firm*—Gene W Arant

(57) ABSTRACT

A food product is packaged in an elongated hollow plastic shell configured to resemble an egg shell with an opening in one of its ends, the opening being sealed by a removable cover having an extending portion forming a finger tab to facilitate its removal. A quantity of edible material consisting primarily of egg white is disposed within the shell.

1 Claim, 1 Drawing Sheet

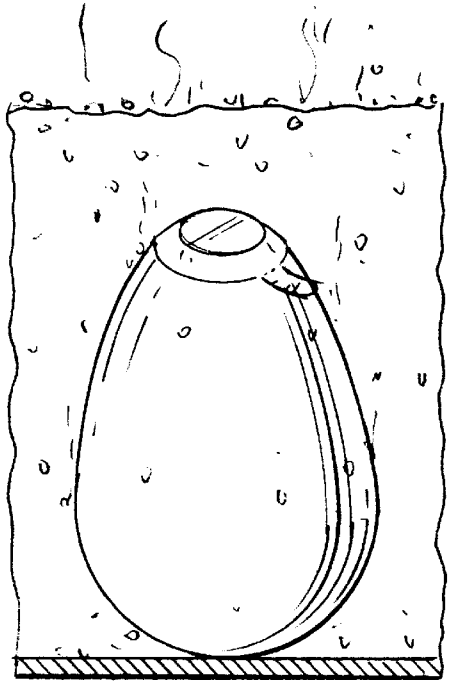
Fig. 1.
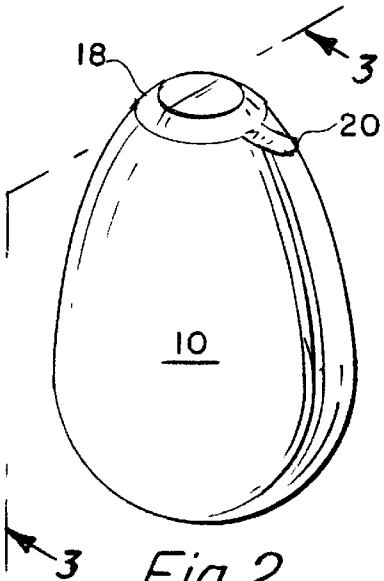
Fig. 2.
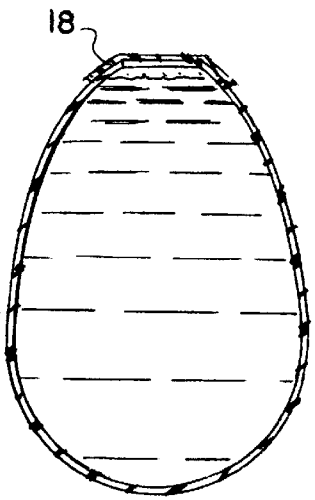
Fig. 3.
Fig. 4.
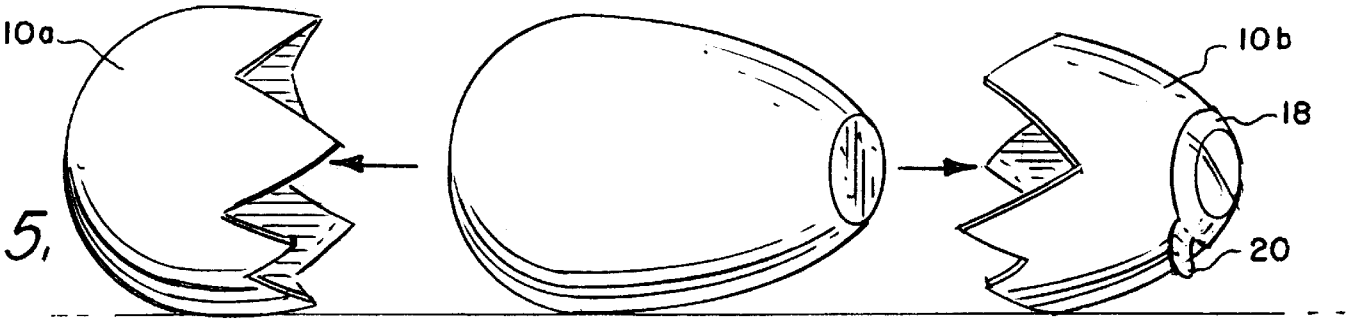
Fig. 5.

FOOD PRODUCT CONTAINED IN AN IMITATION EGG SHELL

RELATED APPLICATION

This application claims the benefit under 35 U.S.C. Sections 119 (e) and 120 of my copending U.S. Provisional Application No. 60/100,700 filed Sep. 17, 1998, which is still pending.

FIELD OF THE INVENTION

The field of this invention is prepared food products.

BACKGROUND OF THE INVENTION

Merchandisers are always looking for ingenious new methods that will assist them in marketing their products. Food products are no exception.

A very common food product is the fresh egg, which is sold in huge volumes in grocery stores. Some people have a need or desire, however, for only a portion of the natural egg. In particular, some people need or desire egg whites, devoid of the yoke.

SUMMARY OF THE INVENTION

According to the presently preferred form of my invention I provide a novel food product comprising a plastic shell configured to resemble an egg, but having an opening formed in one of its ends; a quantity of edible material, at least some portion of which is derivable from an egg, contained within the shell; and a cover removably sealing the opening in the shell.

Further, according to the presently preferred form of my invention I prefer to fill the imitation egg shell with raw egg white in a liquid form. I also prefer that the plastic material be of a white or near-white color, so as to resemble a real egg.

DRAWING SUMMARY

Reference is now made to the drawing, wherein:

FIG. 1 is an elevation view of the imitation shell of the present invention while being filled with a liquid material;

FIG. 2 is a perspective view of a completed food product in accordance with the presently preferred form of the invention, including a removable cover on the shell and a finger tab for attaching or removing the cover;

FIG. 3 is a cross-sectional view of the completed food product of FIG. 2, showing the liquid material inside the shell;

FIG. 4 is an elevation view, partly in cross-section, showing the food product of the present invention placed within a liquid container and wherein the liquid in the container is being boiled to cook the contents of the shell; and FIG. 5 is a perspective view after the shell has been broken open and showing the then-cooked material.

DETAILED DESCRIPTION

Referring now to the drawing, an imitation egg shell 10 is of hollow elongated configuration, with an opening 12 in one of its ends. The opening is preferably no more than half the maximum diameter of the shell.

The shell is easily formed by a conventional blow molding process. Many different types of plastic material are available for making the shell. In selecting the plastic material, among the considerations involved are its cost, the ability of the shell to withstand breakage under compressive force from other objects that may be supported above it, and the ability of the shell to be cracked or broken in a manner similar to the manner in which real egg shells are cracked or broken. I prefer to use a white or near-white material for the shell, so as to closely resemble a real egg.

The thickness of the plastic shell will, in general, be more than the thickness of a real egg shell. For example, it might be twice as thick. The important requirements include the ability of the shell to withstand handling during distribution and sale, as well as its ability to be cracked or broken by the customer.

According to the preferred form of the invention I fill the imitation egg shell with egg white in a liquid form. As shown in FIG. 1, a funnel 14 may be used to fill the shell with liquid egg white. The opening 12 is then closed with a removable plastic cover 18, which is sealed to the surface of the shell 10 around the entire periphery of the opening. The cover 18 has an extending portion 20 that forms a finger tab to facilitate its attachment or removal. The finger tab 20 is not sealed to the exterior surface of the shell 10.

Method of Use

According to the preferred practice of my invention, as shown in the drawing, the imitation egg shell is filled with egg white material in a liquid form. It must then be refrigerated during the distribution and sale process. A customer may then boil the product as shown in FIG. 4, and thereafter crack the shell into individual parts 10*a*, 10*b*, to release the cooked and hence solidified egg white, as is shown in FIG. 5.

Alternatively, it may be desired to cook the product prior to distribution, so that the customer does not have to do the cooking. The product would still typically require refrigeration.

Alternative Forms

According to my invention, in general, the material used to fill the imitation eff shell is at least in part derivable from an egg. My invention also extends to the use of other kinds of material, however. Merchandisers may wish to use other kinds of food, totally unrelated to eggs, to fill the imitation egg shell.

Another way to use my invention is to sell the customer liquid product that may be cooked outside the container. In other words, the imitation egg shell is simply a substitute for a more conventional kind of container. The finger tab 20 is then used to remove the cover member 18, and the liquid material is poured out into another container, for subsequent cooking.

It is also possible to use my invention for a liquid food product that will not need further cooking after purchase by a consumer. Again, the finger tab 20 is used to remove the cover member 18, and the liquid material is poured out into another container. Other modifications will be apparent to those persons skilled in the art. My invention is to be limited only by the scope of the appended claims.

What I claim is:

1. A packaged food product comprising:

an elongated, blow molded, frangible, hollow imitation egg shell made of white or near-white plastic material and being of generally egg-shaped configuration so as to resemble a real egg, said imitation egg shell having a wall thickness about twice as great as the wall thickness of a real egg shell, and having formed in one of its ends an opening the diameter of which is of no more than half the maximum diameter of the shell;

a quantity of raw liquid egg white disposed within the shell;

a cover removably sealing the opening in the shell, the cover being formed of a transparent plastic sheet material, whereby the contents of the shell may be viewed through the cover and the opening in the shell;

the cover having an extending portion, not sealed to the shell, that forms a finger tab to facilitate the removal of the cover;

the frangible plastic imitation egg shell being capable of withstanding breakage under compressive force from other objects that may be supported above it as well as withstanding handling during distribution and sale, yet capable of being cracked or broken in a manner similar to the manner in which a real egg may be cracked or broken by the customer to remove its contents; and the frangible plastic imitation egg shell and cover being capable of allowing the contents to be cooked in the imitation egg shell in boiling liquid.

* * * * *